US010507569B1

(12) United States Patent
Marotta

(10) Patent No.: US 10,507,569 B1
(45) Date of Patent: Dec. 17, 2019

(54) PIPE-CLEANING ATTACHMENT

(71) Applicant: Michael Marotta, Totowa, NJ (US)

(72) Inventor: Michael Marotta, Totowa, NJ (US)

( * ) Notice: Subject to any disclaimer, the term of this patent is extended or adjusted under 35 U.S.C. 154(b) by 225 days.

(21) Appl. No.: 15/798,572

(22) Filed: Oct. 31, 2017

(51) Int. Cl.

| | |
|---|---|
| ***A46B 13/02*** | (2006.01) |
| ***B08B 9/023*** | (2006.01) |
| ***B08B 9/027*** | (2006.01) |
| ***B25F 5/00*** | (2006.01) |
| ***B08B 1/04*** | (2006.01) |
| ***A46B 13/00*** | (2006.01) |

(52) U.S. Cl.
CPC ..... *B25F 5/001* (2013.01); *A46B 13/001* (2013.01); *A46B 13/006* (2013.01); *A46B 13/02* (2013.01); *B08B 1/04* (2013.01); *B08B 9/023* (2013.01); *B08B 9/027* (2013.01); *A46B 2200/3013* (2013.01)

(58) Field of Classification Search
CPC ..... A46B 13/001; A46B 13/02; B08B 9/023; B08B 9/027
See application file for complete search history.

(56) References Cited

U.S. PATENT DOCUMENTS 3,188,674 A * 6/1965 Hobbs ..... A46B 7/04 15/179
5,099,537 A * 3/1992 Denny ..... A47L 15/0068 15/104.03
5,269,104 A 12/1993 DiBiaglo
5,307,534 A * 5/1994 Miller ..... B08B 9/021 15/104.04
6,106,370 A 8/2000 Carter
6,698,048 B1 3/2004 Greene
6,964,077 B2 * 11/2005 Kadinger ..... B08B 9/021 15/104.03
6,983,508 B2 * 1/2006 Saurer ..... A46B 13/001 15/104.04
7,124,882 B1 * 10/2006 Jadydy ..... B08B 9/021 206/234
D598,173 S 8/2009 Hartel
8,101,026 B1 1/2012 Brooks
8,458,845 B1 * 6/2013 Tabieros ..... A46B 5/0095 15/104.05
8,613,642 B2 12/2013 Bowles
2004/0255414 A1 12/2004 Tulipana

FOREIGN PATENT DOCUMENTS

CA 277387 A1 4/2016

* cited by examiner

*Primary Examiner* — Randall E Chin

(57) ABSTRACT

The pipe-cleaning attachment is a kit. The pipe-cleaning attachment is configured for use with a copper pipe. The pipe-cleaning attachment is a tool that cleans the interior surface and the exterior surface of the copper pipe in preparation for processing. By processing is meant one of several plumbing procedures including, but not limited to, soldering the copper pipe or cutting the copper pipe. The pipe-cleaning attachment is an electrically powered rotating brush that physically cleans the copper pipe. The pipe-cleaning attachment comprises a plurality of cleaning kits and a drive system. The plurality of cleaning kits comprises a collection of brushes. The drive system rotates a brush selected from the plurality of cleaning kits to clean the copper pipe.

17 Claims, 4 Drawing Sheets

PIPE-CLEANING ATTACHMENT

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of separating and mixing including cleaning apparatus, more specifically, a tool for cleaning hollow articles.

SUMMARY OF INVENTION

The pipe-cleaning attachment is a kit. The pipe-cleaning attachment is configured for use with a copper pipe. The pipe-cleaning attachment is a tool that cleans the interior surface and the exterior surface of the copper pipe in preparation for processing. By processing is meant one of several plumbing procedures including, but not limited to, soldering the copper pipe or cutting the copper pipe. The pipe-cleaning attachment is an electrically powered rotating brush that physically cleans the copper pipe. The pipe-cleaning attachment comprises a plurality of cleaning kits and a drive system. The plurality of cleaning kits comprises a collection of brushes. The drive system rotates a brush selected from the plurality of cleaning kits to clean the copper pipe.

These together with additional objects, features and advantages of the pipe-cleaning attachment will be readily apparent to those of ordinary skill in the art upon reading the following detailed description of the presently preferred, but nonetheless illustrative, embodiments when taken in conjunction with the accompanying drawings.

In this respect, before explaining the current embodiments of the pipe-cleaning attachment in detail, it is to be understood that the pipe-cleaning attachment is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the pipe-cleaning attachment.

It is therefore important that the claims be regarded as including such equivalent construction insofar as they do not depart from the spirit and scope of the pipe-cleaning attachment. it is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
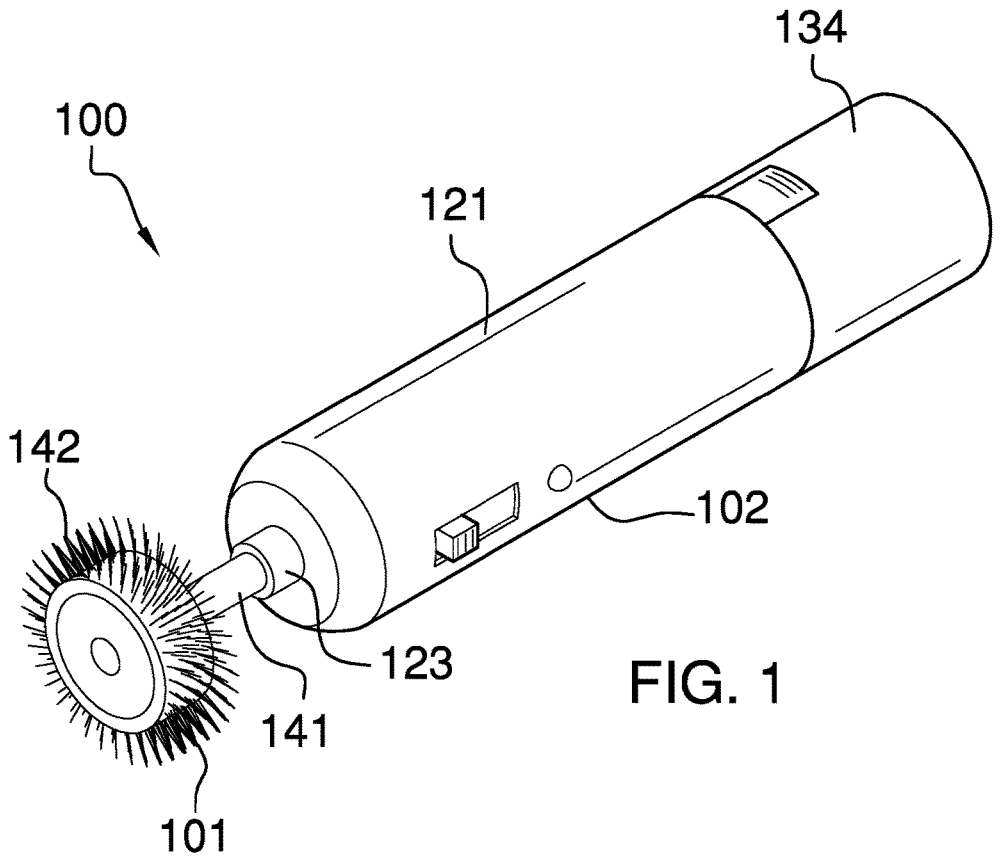
FIG. 1 is a perspective view of an embodiment of the disclosure.
Figure 2:
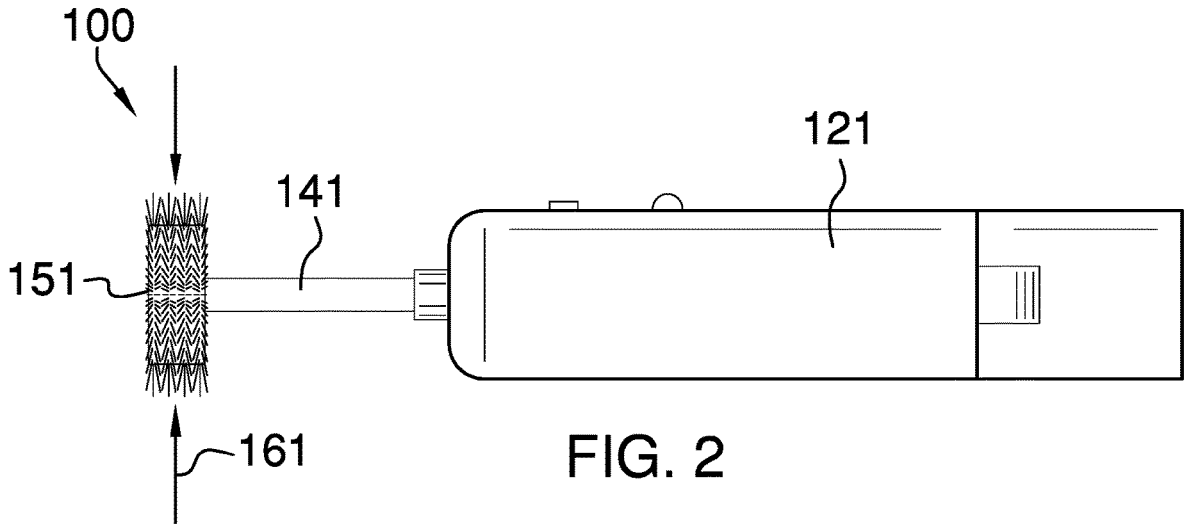
FIG. 2 is a side view of an embodiment of the disclosure.
Figure 3:
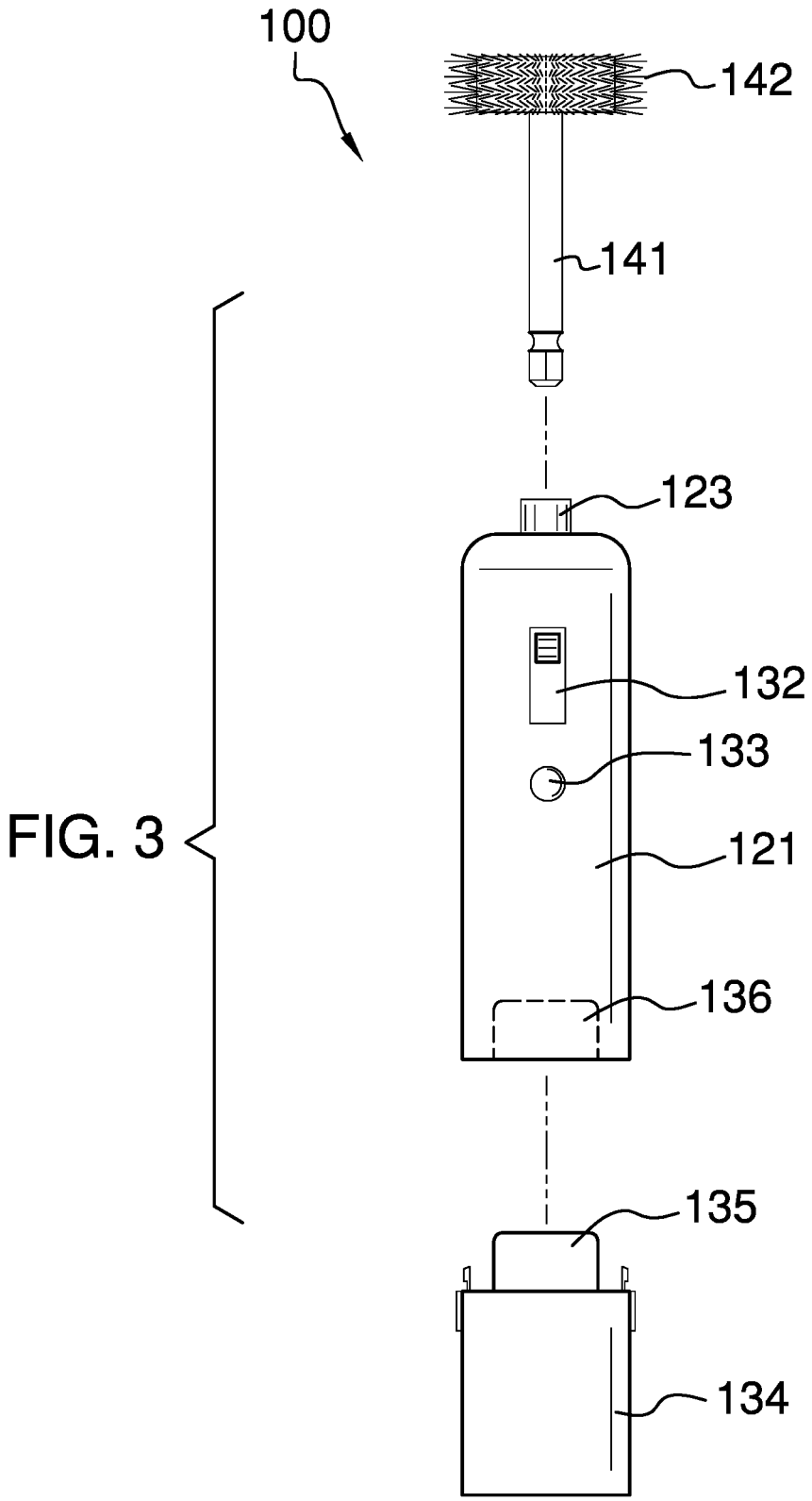
FIG. 3 is an exploded view of an embodiment of the disclosure.
Figure 4:
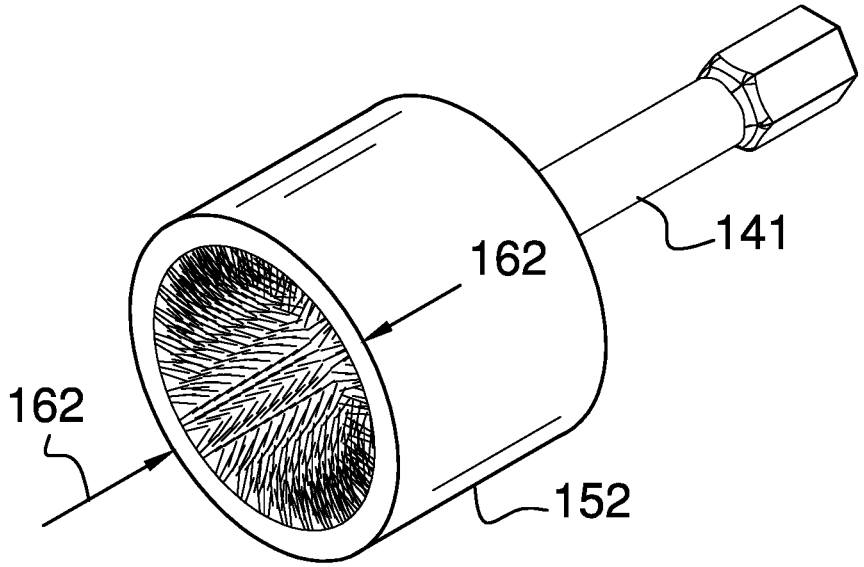
FIG. 4 is a perspective view of an alternate embodiment of the disclosure.
Figure 5:
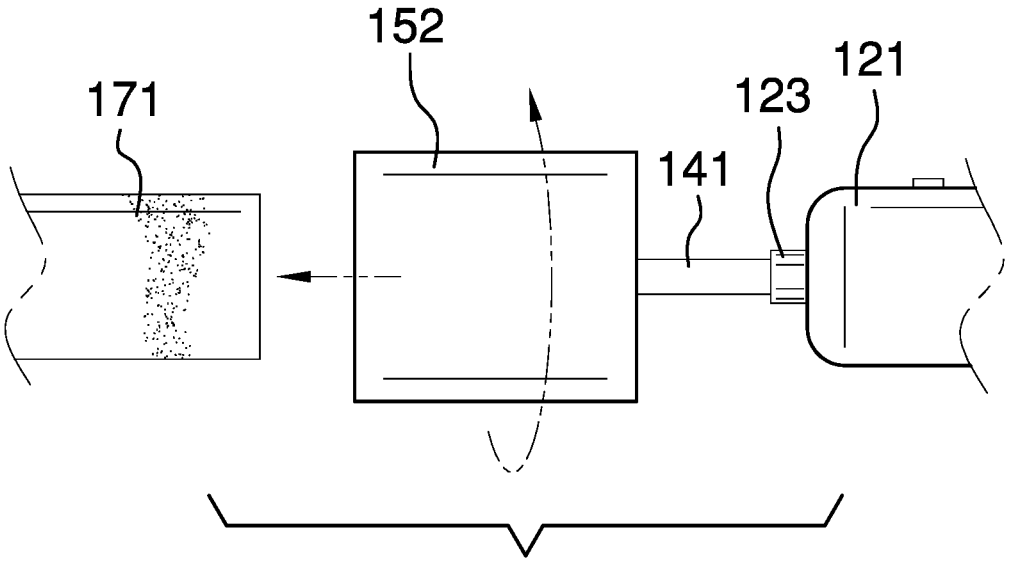
FIG. 5 is an in-use view of an embodiment of the disclosure.
Figure 6:
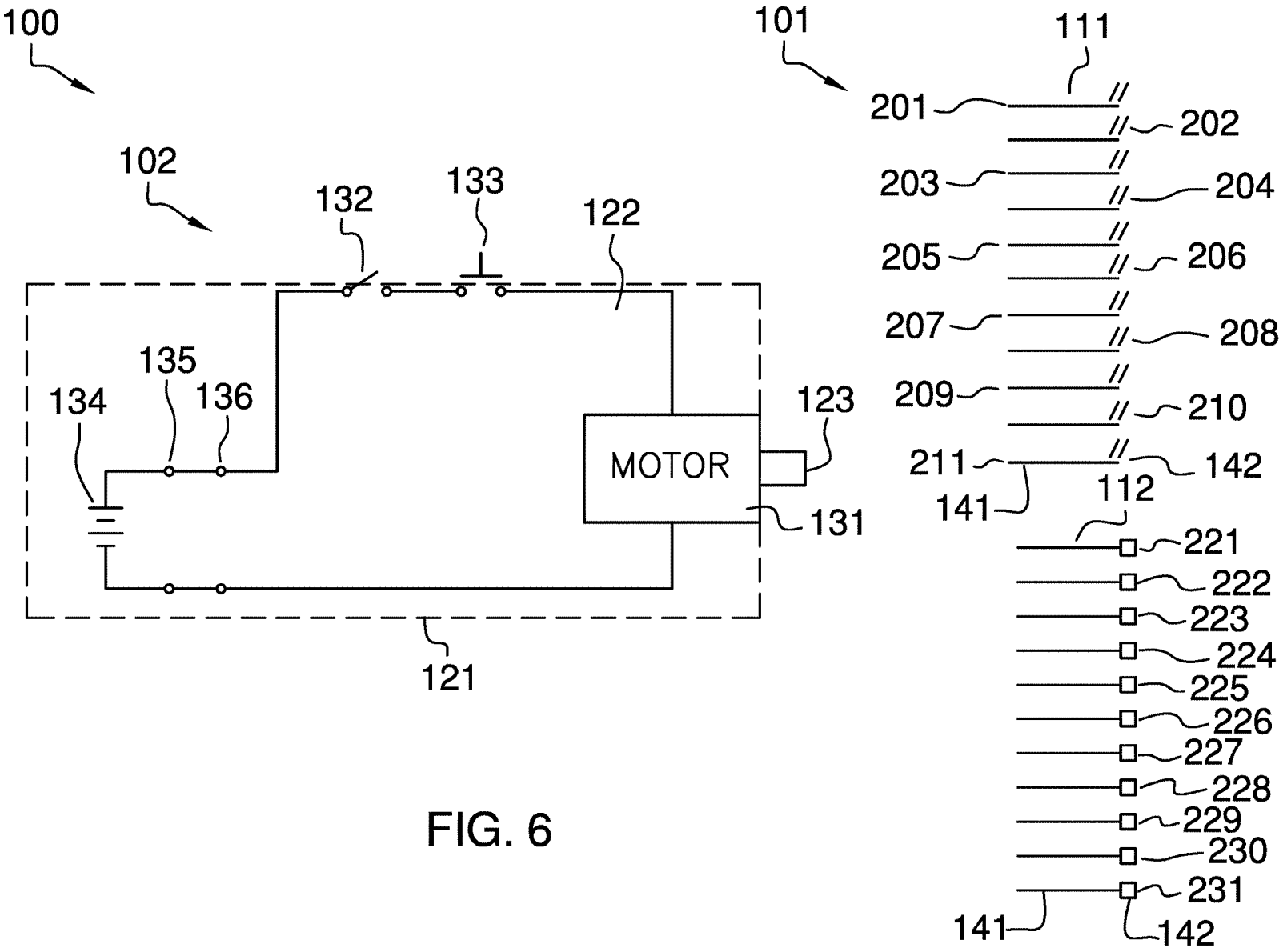
FIG. 6 is a schematic view of an embodiment of the disclosure.

Detailed reference will now be made to one or more potential embodiments of the disclosure, which are illustrated in FIGS. 1 through 6.

The pipe-cleaning attachment 100 (hereinafter invention) is a kit. The invention 100 is configured for use with a copper pipe 171. The copper pipe 171 refers to a commercially available class of pipes commonly used for residential plumbing. The invention 100 is a hand-held tool that cleans the interior surface and the exterior surface of the copper pipe 171 in preparation for processing. By processing is meant one of several plumbing procedures including, but not limited to, soldering the copper pipe 171 or cutting the copper pipe 171. The invention 100 comprises a plurality of cleaning kits 101 and a drive system 102. The plurality of cleaning kits 101 comprises a collection of brushes. Each brush selected from the plurality of cleaning kits 101 physically cleans the copper pipe 171. The drive system 102 rotates any brush selected from the plurality of cleaning kits 101 to clean the copper pipe 171. The drive system 102 is electrically powered. The brushes contained within the plurality of cleaning kits 101 are interchangeable.

The drive system 102 is an electrically driven device. The drive system 102 rotates any brush selected from the plurality of cleaning kits 101 such that the selected brush will clean the copper pipe 171. The drive system 102 also serves as the handle of the invention 100. The drive system 102 comprises a housing 121, a motor system 122, and a chuck 123.

The housing 121 is a casing within which the balance of the drive system 102 is contained. The housing 121 is formed with all apertures and form factors necessary to allow the housing 121 to accommodate the use and operation of the invention 100. The chuck 123 is a mechanical device that attaches any brush selected from the plurality of cleaning kits 101 to the motor system 122 such that the motor system 122 will rotate the selected brush. The chuck 123 is a well-known and commercially available device that is used to attach shafts to a rotating device.

The motor system 122 is an electrically powered drive apparatus that physically rotates any brush selected from the plurality of cleaning kits 101. The motor system 122 comprises an electric motor 131, a master switch 132, a cleaning switch 133, a battery 134, a power plug 135, and a power port 136.

The electric motor 131 is a commercially available electrical device. The electric motor 131 generates the rotational forces required to rotate any brush selected from the plurality of cleaning kits 101.

The master switch 132 is a commercially available electrical device that is accessible from the exterior of the housing 121. The master switch 132 is a maintained switch. The master switch 132 enables and interrupts the flow of electricity from the battery 134 to the cleaning switch 133.

The cleaning switch 133 is a commercially available electrical device that is accessible from the exterior of the housing 121. The cleaning switch 133 is a normally open momentary switch. The cleaning switch 133 enables and interrupts the flow of electricity from the master switch 132 to the electric motor 131. The cleaning switch 133 is used to operate the motor system 122 during normal use of the invention 100. The cleaning switch 133 and the master switch 132 are electrically connected in series such that the cleaning switch 133 is disabled unless the master switch 132 is in a closed position.

The battery 134 is a chemical device that provides the electrical energy required to operate the electric motor 131. The battery 134 is a commercially available rechargeable battery 134. The battery 134 is removably attached to the motor system 122 using the power plug 135 and the power port 136. The use of a rechargeable battery 134 in electrical circuits is well-known and documented in the electrical arts. Methods to removably attach a battery 134 to an electrical circuit are well-known and documented in the electrical arts.

The power plug 135 is an electrical device that attaches the battery 134 to the balance of the motor system 122. The power plug 135 inserts into the power port 136. The power port 136 is an electrical device that: 1) forms an electrical connection with the power plug 135; and 2) forms an electrical connection with the master switch 132 such that electricity can flow from the battery 134 to the balance of the motor system 122. The use of electrical ports and electrical plugs for the purposes described here are well-known and documented in the electrical arts.

The plurality of cleaning kits 101 refer to a collection of individual cleaning kits. Each cleaning kit comprises a collection of brushes. Any brush selected from the plurality of cleaning kits 101 will clean an area of the copper pipe 171 selected from the group consisting of the interior surface of the copper pipe 171 and the exterior surface of the copper pipe 171. Any brush selected from the plurality of cleaning kits 101 will attach to the drive system 102. Each brush contained within the plurality of cleaning kits 101 further comprises a bit shaft 141 and a bit head 142. Each bit head 142 is selected from the group consisting of a brush head 151 and a cylinder head 152.

The bit shaft 141 is a roughly cylindrical device commonly referred to as a bit. The bit shaft 141 is configured to attach to the chuck 123. The bit shaft 141 is an extension structure that separates the bit head 142 from the chuck 123. The bit head 142 is a brush that is used to clean the copper pipe 171.

The bit head 142 attaches to the end of the bit shaft 141 that is distal from the end of the bit shaft 141 that attaches to the chuck 123. The bit head 142 attaches to the bit shaft 141 such that the bit head 142 forms a rotating cleaning surface when the invention 100 is normally used.

The brush head 151 is used to clean the interior surface of the copper pipe 171. The brush head 151 comprises a first plurality of bristles that project radially away from the center axis of the bit shaft 141. The brush head 151 inserts into the copper pipe 171 during normal use of the invention 100. The brush head 151 rotates around an axis of rotation aligned with the bit shaft 141.

The cylinder head 152 is a capped pipe that attaches to the bit shaft 141 such that the center axis of the cylinder head 152 aligns with the center axis of the bit shaft 141. The cylinder head 152 cleans the exterior surface of the copper pipe 171. The interior surfaces of the cylinder head 152 are fitted with a second plurality of bristles that forms a brush within the cylinder head 152. Each of the second plurality of bristles contained within the cylinder head 152 projects away from the interior surface of the cylinder head 152 in a radial manner towards the center axis of the cylinder head 152. The copper pipe 171 inserts into the cylinder head 152 during normal use of the invention 100. The cylinder head 152 rotates around an axis of rotation aligned with the both the center axis of the bit shaft 141 and the center axis of the cylinder head 152.

The plurality of cleaning kits 101 further comprises an inner pipe kit 111 and an outer pipe kit 112. The plurality of cleaning kits 101 is organized such that each brush that is fitted with a brush head 151 is contained within the inner pipe kit 111 and each brush that is fitted with a cylinder head 152 is contained within the outer pipe kit 112. The brush head 151 of each brush contained within the inner pipe kit 111 is further defined with an outer diameter 161. The cylinder head 152 of each brush contained within the outer pipe kit 112 is further defined with an inner diameter 162.

The outer diameter 161 refers to the span of a line segment that: 1) is perpendicular to the axis of rotation of the brush head 151; and, 2) is terminated at both ends by the free ends of the bristles that form the brush head 151. The inner diameter 162 refers to the span of a line segment that: 1) is perpendicular to the axis of rotation of the cylinder head 152; and, 2) is terminated at both ends by the free ends of the bristles that form the cylinder head 152.

The inner pipe kit 111 comprises a collection of interior cleaning bits. A brush head 151 attaches to each of the interior cleaning bits. Each of the interior cleaning bits is inserted into the copper pipe 171 such that the interior cleaning bit will clean the interior surface of the copper pipe 171. Any primary interior cleaning bit selected from the inner pipe kit 111 will differ from any subsequent interior cleaning bit selected from the inner pipe kit 111 by the span of the outer diameter 161. Any interior cleaning bit contained within the inner pipe kit 111 attaches to the drive system 102 such that the drive system 102 will rotate the interior cleaning bit.

The outer pipe kit 112 comprises a collection of exterior cleaning bits. A cylinder head 152 attaches to each of the exterior cleaning bits. The copper pipe 171 inserts into the exterior cleaning bit such that the exterior cleaning bit will clean the exterior surface of the copper pipe 171. Any primary exterior cleaning bit selected from the outer pipe kit 112 will differ from any subsequent exterior cleaning bit selected from the outer pipe kit 112 by the span of the inner diameter 162. Any exterior cleaning bit contained within the outer pipe kit 112 attaches to the drive system 102 such that the drive system 102 will rotate the exterior cleaning bit.

To match an interior cleaning bit selected from the inner pipe kit 111 to a copper pipe 171, the outer diameter 161 of the selected interior cleaning bit will be less than the span of the inner diameter of the copper pipe 171. To match an exterior cleaning bit selected from the outer pipe kit 112 to a copper pipe 171, the inner diameter 162 of the selected exterior cleaning bit will be greater than the span of the outer diameter of the copper pipe 171.

The inner pipe kit 111 comprises a first interior cleaning bit 201, a second interior cleaning bit 202, a third interior cleaning bit 203, a fourth interior cleaning bit 204, a fifth interior cleaning bit 205, a sixth interior cleaning bit 206, a seventh interior cleaning bit 207, an eighth interior cleaning bit 208, a ninth interior cleaning bit 209, and a tenth interior cleaning bit 210.

In the first and the second potential embodiments of the disclosure, the inner pipe kit 111 further comprises an eleventh interior cleaning bit 211.

The outer pipe kit 112 comprises a first exterior cleaning bit 221, a second exterior cleaning bit 222, a third exterior cleaning bit 223, a fourth exterior cleaning bit 224, a fifth exterior cleaning bit 225, a sixth exterior cleaning bit 226, a seventh exterior cleaning bit 227, an eighth exterior cleaning bit 228, a ninth exterior cleaning bit 229, a tenth exterior cleaning bit 230, and an eleventh exterior cleaning bit 231.

In the first potential embodiment of the disclosure, the inner pipe kit 111 is configured for use with Type K schedule copper tubing commonly used in domestic plumbing. In Type K copper tubing, the nominal outer diameter 161 of the brush head 151 of the brush head 151 of the first interior cleaning bit 201 is 0.3 inches (7.7 mm). The nominal outer diameter 161 of the brush head 151 of the second interior cleaning bit 202 is 0.4 inches (10.2 mm). The nominal outer diameter 161 of the brush head 151 of the third interior cleaning bit 203 is 0.52 inches (13.4 mm). The nominal outer diameter 161 of the brush head 151 of the fourth interior cleaning bit 204 is 0.65 inches (16.5 mm). The nominal outer diameter 161 of the brush head 151 of the fifth interior cleaning bit 205 is 0.74 inches (18.9 mm).

The nominal outer diameter 161 of the brush head 151 of the sixth interior cleaning bit 206 is 0.99 inches (25.2 mm). The nominal outer diameter 161 of the brush head 151 of the seventh interior cleaning bit 207 is 1.24 inches (31.6 mm). The nominal outer diameter 161 of the brush head 151 of the eighth interior cleaning bit 208 is 1.48 inches (37.6 mm). The nominal outer diameter 161 of the brush head 151 of the ninth interior cleaning bit 209 is 1.95 inches (49.7 mm). The nominal outer diameter 161 of the brush head 151 of the tenth interior cleaning bit 210 is 2.43 inches (61.8 mm). The nominal outer diameter 161 of the brush head 151 of the eleventh interior cleaning bit 211 is 2.9 inches (73.8 mm).

In the second potential embodiment of the disclosure, the inner pipe kit 111 is configured for use with Type L schedule copper tubing commonly used in domestic plumbing. In Type L copper tubing, the nominal outer diameter 161 of the brush head 151 of the first interior cleaning bit 201 is 0.31 inches (8 mm). The nominal outer diameter 161 of the brush head 151 of the second interior cleaning bit 202 is 0.4 inches (10.2 mm). The nominal outer diameter 161 of the brush head 151 of the third interior cleaning bit 203 is 0.52 inches (13.4 mm). The nominal outer diameter 161 of the brush head 151 of the fourth interior cleaning bit 204 is 0.65 inches (16.5 mm). The nominal outer diameter 161 of the brush head 151 of the fifth interior cleaning bit 205 is 0.74 inches (18.9 mm). The nominal outer diameter 161 of the brush head 151 of the sixth interior cleaning bit 206 is 0.99 inches (25.2 mm).

The nominal outer diameter 161 of the brush head 151 of the seventh interior cleaning bit 207 is 1.24 inches (31.6 mm). The nominal outer diameter 161 of the brush head 151 of the eighth interior cleaning bit 208 is 1.48 inches (37.6 mm). The nominal outer diameter 161 of the brush head 151 of the ninth interior cleaning bit 209 is 1.95 inches (49.7 mm). The nominal outer diameter 161 of the brush head 151 of the tenth interior cleaning bit 210 is 2.43 inches (61.8 mm). The nominal outer diameter 161 of the brush head 151 of the eleventh interior cleaning bit 211 is 2.9 inches (73.8 mm).

In the second potential embodiment of the disclosure, the inner pipe kit 111 is configured for use with Type M schedule copper tubing commonly used in domestic plumbing. In Type M copper tubing, the nominal outer diameter 161 of the brush head 151 of the first interior cleaning bit 201 is 0.45 inches (11.4 mm). The nominal outer diameter 161 of the brush head 151 of the second interior cleaning bit 202 is 0.56 inches (14.4 mm). The nominal outer diameter 161 of the brush head 151 of the third interior cleaning bit 203 is 0.69 inches (17.5 mm). The nominal outer diameter 161 of the brush head 151 of the fourth interior cleaning bit 204 is 0.81 inches (20.5 mm). The nominal outer diameter 161 of the brush head 151 of the fifth interior cleaning bit 205 is 1.05 inches (26.7 mm). The nominal outer diameter 161 of the brush head 151 of the sixth interior cleaning bit 206 is 1.29 inches (32.7 mm).

The nominal outer diameter 161 of the brush head 151 of the seventh interior cleaning bit 207 is 1.52 inches (38.7 mm). The nominal outer diameter 161 of the brush head 151 of the eighth interior cleaning bit 208 is 2 inches (51 mm). The nominal outer diameter 161 of the brush head 151 of the ninth interior cleaning bit 209 is 2.49 inches (63.3 mm). The nominal outer diameter 161 of the brush head 151 of the tenth interior cleaning bit 210 is 2.98 inches (75.7 mm). The eleventh interior cleaning bit 211 is excluded from the third potential embodiment of the disclosure.

In all potential embodiments of the disclosure, the nominal inner diameter 162 of the cylinder head 152 of the first exterior cleaning bit 221 is 0.38 inches (9.5 mm). The nominal inner diameter 162 of the cylinder head 152 of the second exterior cleaning bit 222 is 0.5 inches (12.7 mm). The nominal inner diameter 162 of the cylinder head 152 of the third exterior cleaning bit 223 is 0.63 inches (15.9 mm). The nominal inner diameter 162 of the cylinder head 152 of the fourth exterior cleaning bit 224 is 0.75 inches (19.1 mm). The nominal inner diameter 162 of the cylinder head 152 of the fifth exterior cleaning bit 225 is 0.88 inches (22.3 mm). The nominal inner diameter 162 of the cylinder head 152 of the sixth exterior cleaning bit 226 is 1.13 inches (28.6 mm). The nominal inner diameter 162 of the cylinder head 152 of the seventh exterior cleaning bit 227 is 1.38 inches (35 mm).

The nominal inner diameter 162 of the cylinder head 152 of the eighth exterior cleaning bit 228 is 1.63 inches (41.3 mm). The nominal inner diameter 162 of the cylinder head 152 of the ninth exterior cleaning bit 229 is 2.13 inches (54 mm). The nominal inner diameter 162 of the cylinder head 152 of the tenth exterior cleaning bit 230 is 2.63 inches (66.7 mm). The nominal inner diameter 162 of the cylinder head 152 of the eleventh exterior cleaning bit 231 is 3.13 inches (79.4 mm).

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Battery: As used in this disclosure, a battery is a chemical device consisting of one or more cells, in which chemical energy is converted into electricity and used as a source of power.

Bit: As used in this disclosure, a bit is the working end of a rotating tool. Bits are often interchangeable in a tool. A bit is typically cylindrical in shape. Examples of the use of a bit include, but are not limited to, boring holes or driving screws. Bits are often formed with a magnetic material.

Bristle: As used in this disclosure, a bristle is a short coarse stiff hair or wire-like object.

Brush: As used in this disclosure, a brush is a device comprising a plurality of bristles set into a handle or a base that is used for grooming, sweeping, smoothing, scrubbing, or painting.

Capped Pipe: As used in this disclosure, a capped pipe is a pipe with one closed end and one open end.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Center of Rotation: As used in this disclosure, the center of rotation is the point of a rotating plane that does not move with the rotation of the plane. A line within a rotating three-dimensional object that does not move with the rotation of the object is also referred to as an axis of rotation.

Cylinder: As used in this disclosure, a cylinder is a geometric structure defined by two identical flat and parallel ends, also commonly referred to as bases, which are circular in shape and connected with a single curved surface, referred to in this disclosure as the face. The cross-section of the cylinder remains the same from one end to another. The axis of the cylinder is formed by the straight line that connects the center of each of the two identical flat and parallel ends of the cylinder. Unless otherwise stated within this disclosure, the term cylinder specifically means a right cylinder which is defined as a cylinder wherein the curved surface perpendicularly intersects with the two identical flat and parallel ends.

Electric Motor: In this disclosure, an electric motor is a machine that converts electric energy into rotational mechanical energy.

Extension Structure: As used in this disclosure, an extension structure is an inert physical structure that is used to extend the span of the distance between any two objects.

Form Factor: As used in this disclosure, the term form factor refers to the size and shape of an object.

Handle: As used in this disclosure, a handle is an object by which a tool, object, or door is held or manipulated with the hand.

Housing: As used in this disclosure, a housing is a rigid casing that encloses and protects one or more devices.

Inner Diameter: As used in this disclosure, the term inner diameter is used in the same way that a plumber would refer to the inner diameter of a pipe.

Maintained Switch: A used in this disclosure, a maintained switch is a switch that maintains the position that was set in the most recent switch actuation. A maintained switch works in an opposite manner to a momentary switch.

Momentary Switch: As used in this disclosure, a momentary switch is a biased switch in the sense that the momentary switch has a baseline position that only changes when the momentary switch is actuated (for example when a pushbutton switch is pushed). The momentary switch then returns to the baseline position once the actuation is completed. This baseline position is called the "normal" position. For example, a "normally open" momentary switch interrupts (open) the electric circuit in the baseline position and completes (closes) the circuit when the momentary switch is activated. Similarly, a "normally closed" momentary switch will complete (close) an electric circuit in the baseline position and interrupt (open) the circuit when the momentary switch is activated.

Motor: As used in this disclosure, a motor refers to the method of transferring energy from an external power source into mechanical energy.

Nominal: As used in this disclosure, the term nominal refers to a designed or intended value of the measure of a physical parameter of an object. The use of the term nominal implies that the exact value of the physical parameter of an instantiation of the object can have insignificant variation from the nominal value. By insignificant is meant that these variations will not interfere with the intended use of the object. The sources of variations can include, but are not limited to, manufacturing tolerances and traditional rounding practices such as those employed in the sale of lumber or plumbing supplies.

Outer Diameter: As used in this disclosure, the term outer diameter is used in the same way that a plumber would refer to the outer diameter of a pipe.

Pipe: As used in this disclosure, a pipe is a rigid hollow cylindrical device used for transporting liquids and gases. The line that connects the center of the first base of the cylinder to the center of the second base of the cylinder is referred to as the axis of the cylinder or the centerline of the pipe. When two pipes share the same centerline they are said to be aligned. In this disclosure, the terms inner diameter of a pipe and outer diameter are used as they would be used by those skilled in the plumbing arts.

Plug: As used in this disclosure, a plug is an electrical termination that electrically connects a first electrical circuit to a second electrical circuit or a source of electricity. As used in this disclosure, a plug will have two or three metal pins.

Port: As used in this disclosure, a port is an electrical termination that is used to connect a first electrical circuit to a second external electrical circuit. In this disclosure, the port is designed to receive a plug.

Radial: As used in this disclosure, the term radial refers to a direction that: 1) is perpendicular to an identified central axis; or, 2) projects away from a center point.

Shaft: As used in this disclosure, a shaft is a long, narrow and rigid cylindrical structure that is used as: 1) a structural element of a larger object; or 2) as a grip or lever for a handle.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A kit of cleaning tools comprising:

a plurality of cleaning kits and a drive system;

wherein the drive system powers any element contained in the plurality of cleaning kits;

wherein the kit of cleaning tools is a kit of hand-held tools;

wherein the kit of cleaning tools is configured for use with a copper pipe;

wherein the copper pipe is further defined with an interior surface and an exterior surface;

wherein the kit of cleaning tools cleans the interior surface of the copper pipe;

wherein the kit of cleaning tools cleans the exterior surface of the copper pipe;

wherein each cleaning kit contained within the plurality of cleaning kits comprises a collection of brushes;

wherein any brush selected from any cleaning kit selected from the plurality of cleaning kits will clean an area of the copper pipe selected from the group consisting of the interior surface of the copper pipe and the exterior surface of the copper pipe;

wherein any brush selected from any cleaning kit selected from the plurality of cleaning kits will attach to the drive system;

wherein the brushes are interchangeable;

wherein the drive system is an electrically driven device;

wherein the drive system rotates any brush selected from the plurality of cleaning kits;

wherein the drive system comprises a housing, a motor system, and a chuck;

wherein the motor system and the chuck are installed in the housing;

wherein the chuck is a mechanical device that attaches any brush selected from the plurality of cleaning kits to the motor system such that the motor system will rotate the selected brush;

wherein the motor system is an electrically powered drive apparatus that physically rotates any brush selected from the plurality of cleaning kits;

wherein the motor system comprises an electric motor, a master switch, a cleaning switch, a battery, a power plug, and a power port;

wherein the electric motor, the master switch, the cleaning switch, the battery, the power plug, and the power port are electrically interconnected.

2. The kit of cleaning tools according to claim 1 wherein the electric motor is an electrical device;

wherein the electric motor generates the rotational forces required to rotate any brush selected from the plurality of cleaning kits;

wherein the master switch is a maintained switch;

wherein the cleaning switch is a normally open momentary switch;

wherein the battery is a chemical device;

wherein the battery is rechargeable;

wherein the battery is removably attached to the motor system using the power plug and the power port;

wherein the power plug inserts into the power port.

3. The kit of cleaning tools according to claim 2 wherein the master switch enables and interrupts the flow of electricity from the battery to the cleaning switch;

wherein the cleaning switch enables and interrupts the flow of electricity from the master switch to the electric motor;

wherein the master switch is further defined with a closed position.

4. The kit of cleaning tools according to claim 3 wherein the cleaning switch and the master switch are electrically connected in series such that the cleaning switch is disabled unless the master switch is in a closed position.

5. The kit of cleaning tools according to claim 4 wherein the power port is an electrical device that forms an electrical connection with the power plug;

wherein the power port forms an electrical connection with the master switch such that electricity can flow from the battery to the master switch.

6. The kit of cleaning tools according to claim 5 wherein each brush contained within the plurality of cleaning kits further comprises a bit shaft and a bit head;

wherein the bit shaft attaches to the chuck;

wherein the bit head attaches to the end of the bit shaft that is distal from the end of the bit shaft that attaches to the chuck;

wherein the bit head attaches to the bit shaft such that the bit head forms a rotating cleaning surface.

7. The kit of cleaning tools according to claim 6 wherein the bit shaft is an extension structure that separates the bit head from the chuck;

wherein the bit head is a brush that is used to clean the copper pipe.

8. The kit of cleaning tools according to claim 7 wherein each bit head is selected from the group consisting of a brush head and a cylinder head;

wherein the brush head is used to clean the interior surface of the copper pipe;

wherein the cylinder head cleans the exterior surface of the copper pipe.

9. The kit of cleaning tools according to claim 8
wherein the brush head comprises a first plurality of bristles that project radially away from the center axis of the bit shaft;
wherein the brush head inserts into the copper pipe;
wherein the brush head rotates around an axis of rotation aligned with the bit shaft.

10. The kit of cleaning tools according to claim 9
wherein the cylinder head is a capped pipe;
wherein the cylinder head attaches to the bit shaft such that the center axis of the capped pipe aligns with the center axis of the bit shaft;
wherein the interior surfaces of the cylinder head are fitted with a second plurality of bristles;
wherein each of the second plurality of bristles contained within the cylinder head projects away from the interior surface of the cylinder head in a radial manner towards the center axis of the cylinder head;
wherein the copper pipe inserts into the cylinder head;
wherein the cylinder head rotates around an axis of rotation aligned with the both the center axis of the bit shaft and the center axis of the cylinder head.

11. The kit of cleaning tools according to claim 10
wherein the plurality of cleaning kits further comprises an inner pipe kit and an outer pipe kit;
wherein the plurality of cleaning kits are organized such that each brush that is fitted with a brush head is contained within the inner pipe kit and each brush that is fitted with a cylinder head is contained within the outer pipe kit;
wherein the brush head of each brush contained within the inner pipe kit is further defined with an outer diameter;
wherein the cylinder head of each brush contained within the outer pipe kit is further defined with an inner diameter;
wherein any primary interior cleaning bit selected from the inner pipe kit will differ from any subsequent interior cleaning bit selected from the inner pipe kit by the span of the outer diameter;
wherein any primary exterior cleaning bit selected from the outer pipe kit will differ from any subsequent exterior cleaning bit selected from the outer pipe kit by the span of the inner diameter.

12. The kit of cleaning tools according to claim 11
wherein the inner pipe kit comprises a first interior cleaning bit, a second interior cleaning bit, a third interior cleaning bit, a fourth interior cleaning bit, a fifth interior cleaning bit, a sixth interior cleaning bit, a seventh interior cleaning bit, an eighth interior cleaning bit, a ninth interior cleaning bit, and a tenth interior cleaning bit;
wherein the inner pipe kit further comprises an eleventh interior cleaning bit;
wherein the nominal outer diameter of the brush head of the brush head of the first interior cleaning bit is 0.3 inches;
wherein the nominal outer diameter of the brush head of the second interior cleaning bit is 0.4 inches;
wherein the nominal outer diameter of the brush head of the third interior cleaning bit is 0.52 inches;
wherein the nominal outer diameter of the brush head of the fourth interior cleaning bit is 0.65 inches;
wherein the nominal outer diameter of the brush head of the fifth interior cleaning bit is 0.74 inches;
the nominal outer diameter of the brush head of the sixth interior cleaning bit is 0.99 inches;
wherein the nominal outer diameter of the brush head of the seventh interior cleaning bit is 1.24 inches;
wherein the nominal outer diameter of the brush head of the eighth interior cleaning bit is 1.48 inches;
wherein the nominal outer diameter of the brush head of the ninth interior cleaning bit is 1.95 inches;
wherein the nominal outer diameter of the brush head of the tenth interior cleaning bit is 2.43 inches;
wherein the nominal outer diameter of the brush head of the eleventh interior cleaning bit is 2.9 inches.

13. The kit of cleaning tools according to claim 12
wherein the outer pipe kit comprises a first exterior cleaning bit, a second exterior cleaning bit, a third exterior cleaning bit, a fourth exterior cleaning bit, a fifth exterior cleaning bit, a sixth exterior cleaning bit, a seventh exterior cleaning bit, an eighth exterior cleaning bit, a ninth exterior cleaning bit, a tenth exterior cleaning bit, and an eleventh exterior cleaning bit;
wherein the nominal inner diameter of the cylinder head of the first exterior cleaning bit is 0.38 inches (9.5 mm);
wherein the nominal inner diameter of the cylinder head of the second exterior cleaning bit is 0.5 inches (12.7 mm);
wherein the nominal inner diameter of the cylinder head of the third exterior cleaning bit is 0.63 inches (15.9 mm);
wherein the nominal inner diameter of the cylinder head of the fourth exterior cleaning bit is 0.75 inches (19.1 mm);
wherein the nominal inner diameter of the cylinder head of the fifth exterior cleaning bit is 0.88 inches (2.23 mm);
wherein the nominal inner diameter of the cylinder head of the sixth exterior cleaning bit is 1.13 inches (28.6 mm);
wherein the nominal inner diameter of the cylinder head of the seventh exterior cleaning bit is 1.38 inches (35 mm);
the nominal inner diameter of the cylinder head of the eighth exterior cleaning bit is 1.63 inches (41.3 mm);
wherein the nominal inner diameter of the cylinder head of the ninth exterior cleaning bit is 2.13 inches (54 mm);
wherein the nominal inner diameter of the cylinder head of the tenth exterior cleaning bit is 2.63 inches (66.7 mm);
wherein the nominal inner diameter of the cylinder head of the eleventh exterior cleaning bit is 3.13 inches (79.4 mm).

14. The kit of cleaning tools according to claim 11
wherein the inner pipe kit comprises a first interior cleaning bit, a second interior cleaning bit, a third interior cleaning bit, a fourth interior cleaning bit, a fifth interior cleaning bit, a sixth interior cleaning bit, a seventh interior cleaning bit, an eighth interior cleaning bit, a ninth interior cleaning bit, and a tenth interior cleaning bit;
wherein the inner pipe kit further comprises an eleventh interior cleaning bit;
wherein the nominal outer diameter of the brush head of the first interior cleaning bit is 0.31 inches (8 mm);
wherein the nominal outer diameter of the brush head of the second interior cleaning bit is 0.4 inches (10.2 mm);
wherein the nominal outer diameter of the brush head of the third interior cleaning bit is 0.52 inches (13.4 mm);

wherein the nominal outer diameter of the brush head of the fourth interior cleaning bit is 0.65 inches (16.5 mm);

wherein the nominal outer diameter of the brush head of the fifth interior cleaning bit is 0.74 inches (18.9 mm);

wherein the nominal outer diameter of the brush head of the sixth interior cleaning bit is 0.99 inches (25.2 mm);

the nominal outer diameter of the brush head of the seventh interior cleaning bit is 1.24 inches (31.6 mm);

wherein the nominal outer diameter of the brush head of the eighth interior cleaning bit is 1.48 inches (37.6 mm);

wherein the nominal outer diameter of the brush head of the ninth interior cleaning bit is 1.95 inches (49.7 mm);

wherein the nominal outer diameter of the brush head of the tenth interior cleaning bit is 2.43 inches (61.8 mm);

wherein the nominal outer diameter of the brush head of the eleventh interior cleaning bit is 2.9 inches (73.8 mm).

15. The kit of cleaning tools according to claim 14 wherein the outer pipe kit comprises a first exterior cleaning bit, a second exterior cleaning bit, a third exterior cleaning bit, a fourth exterior cleaning bit, a fifth exterior cleaning bit, a sixth exterior cleaning bit, a seventh exterior cleaning bit, an eighth exterior cleaning bit, a ninth exterior cleaning bit, a tenth exterior cleaning bit, and an eleventh exterior cleaning bit;

wherein the nominal inner diameter of the cylinder head of the first exterior cleaning bit is 0.38 inches (9.5 mm);

wherein the nominal inner diameter of the cylinder head of the second exterior cleaning bit is 0.5 inches (12.7 mm);

wherein the nominal inner diameter of the cylinder head of the third exterior cleaning bit is 0.63 inches (15.9 mm);

wherein the nominal inner diameter of the cylinder head of the fourth exterior cleaning bit is 0.75 inches (19.1 mm);

wherein the nominal inner diameter of the cylinder head of the fifth exterior cleaning bit is 0.88 inches (2.23 mm);

wherein the nominal inner diameter of the cylinder head of the sixth exterior cleaning bit is 1.13 inches (28.6 mm);

wherein the nominal inner diameter of the cylinder head of the seventh exterior cleaning bit is 1.38 inches (35 mm);

the nominal inner diameter of the cylinder head of the eighth exterior cleaning bit is 1.63 inches (41.3 mm);

wherein the nominal inner diameter of the cylinder head of the ninth exterior cleaning bit is 2.13 inches (54 mm);

wherein the nominal inner diameter of the cylinder head of the tenth exterior cleaning bit is 2.63 inches (66.7 mm);

wherein the nominal inner diameter of the cylinder head of the eleventh exterior cleaning bit is 3.13 inches (79.4 mm).

16. The kit of cleaning tools according to claim 11 wherein the inner pipe kit comprises a first interior cleaning bit, a second interior cleaning bit, a third interior cleaning bit, a fourth interior cleaning bit, a fifth interior cleaning bit, a sixth interior cleaning bit, a seventh interior cleaning bit, an eighth interior cleaning bit, a ninth interior cleaning bit, and a tenth interior cleaning bit;

wherein the nominal outer diameter of the brush head of the first interior cleaning bit is 0.45 inches (11.4 mm);

wherein the nominal outer diameter of the brush head of the second interior cleaning bit is 0.56 inches (14.4 mm);

wherein the nominal outer diameter of the brush head of the third interior cleaning bit is 0.69 inches (17.5 mm);

wherein the nominal outer diameter of the brush head of the fourth interior cleaning bit is 0.81 inches (20.5 mm);

wherein the nominal outer diameter of the brush head of the fifth interior cleaning bit is 1.05 inches (26.7 mm);

wherein the nominal outer diameter of the brush head of the sixth interior cleaning bit is 1.29 inches (32.7 mm);

the nominal outer diameter of the brush head of the seventh interior cleaning bit is 1.52 inches (38.7 mm);

wherein the nominal outer diameter of the brush head of the eighth interior cleaning bit is 2 inches (51 mm);

wherein the nominal outer diameter of the brush head of the ninth interior cleaning bit is 2.49 inches (63.3 mm);

wherein the nominal outer diameter of the brush head of the tenth interior cleaning bit is 2.98 inches (75.7 mm).

17. The kit of cleaning tools according to claim 16 wherein the outer pipe kit comprises a first exterior cleaning bit, a second exterior cleaning bit, a third exterior cleaning bit, a fourth exterior cleaning bit, a fifth exterior cleaning bit, a sixth exterior cleaning bit, a seventh exterior cleaning bit, an eighth exterior cleaning bit, a ninth exterior cleaning bit, a tenth exterior cleaning bit, and an eleventh exterior cleaning bit;

wherein the nominal inner diameter of the cylinder head of the first exterior cleaning bit is 0.38 inches (9.5 mm);

wherein the nominal inner diameter of the cylinder head of the second exterior cleaning bit is 0.5 inches (12.7 mm);

wherein the nominal inner diameter of the cylinder head of the third exterior cleaning bit is 0.63 inches (15.9 mm);

wherein the nominal inner diameter of the cylinder head of the fourth exterior cleaning bit is 0.75 inches (19.1 mm);

wherein the nominal inner diameter of the cylinder head of the fifth exterior cleaning bit is 0.88 inches (2.23 mm);

wherein the nominal inner diameter of the cylinder head of the sixth exterior cleaning bit is 1.13 inches (28.6 mm);

wherein the nominal inner diameter of the cylinder head of the seventh exterior cleaning bit is 1.38 inches (35 mm);

the nominal inner diameter of the cylinder head of the eighth exterior cleaning bit is 1.63 inches (41.3 mm);

wherein the nominal inner diameter of the cylinder head of the ninth exterior cleaning bit is 2.13 inches (54 mm);

wherein the nominal inner diameter of the cylinder head of the tenth exterior cleaning bit is 2.63 inches (66.7 mm);

wherein the nominal inner diameter of the cylinder head of the eleventh exterior cleaning bit is 3.13 inches (79.4 mm).

* * * * *